United States Patent [19]

Pedretti

[11] 4,208,751

[45] Jun. 24, 1980

[54] DEVICE FOR FOOTWEAR UPPER ASSEMBLING ON RESPECTIVE LASTS OR SHOE TREES

[75] Inventor: Gaetano Pedretti, Vigevano, Italy

[73] Assignee: Cerim S.p.A., Vigevano, Italy

[21] Appl. No.: 844,105

[22] Filed: Oct. 20, 1977

[30] Foreign Application Priority Data

Apr. 18, 1977 [IT] Italy ..... 22548 A/77

[51] Int. Cl.[2] ..... A43D 21/00

[52] U.S. Cl. ..... 12/10

[58] Field of Search ..... 12/10, 10.1, 10.5, 12

[56] References Cited

U.S. PATENT DOCUMENTS

| | | | |
|---|---|---|---|
| 3,168,752 | 2/1965 | Quarmby | 12/12 |
| 3,222,703 | 12/1965 | Broughton et al. | 12/12 |
| 3,258,799 | 7/1966 | Weinschenk | 12/12 |

*Primary Examiner*—Patrick D. Lawson

*Attorney, Agent, or Firm*—Haseltine, Lake & Waters

[57] ABSTRACT

The device according to the invention employs a known clamping assembly to clamp the upper edge to stretch and fold up the edge against the sole. Complementary clamping clips hold the upper edge at the last or to a shoe tree hollow. Also present is a right set and left set of members for upper edge adherence at the last or shoe tree hollow. The aforementioned members are divided into two or more sections independently oscillating about axes approximately parallel to the direction of approaching movement to the last or shoe tree, and independently oscillating about an axis which is approximately horizontal and perpendicular to said direction. The oscillation being controlled by motors that are independent for each individual section. Moreover, each of the right and left sets, is adjustable in height and orientable about an axis parallel to the last or shoe tree approach direction.

1 Claim, 4 Drawing Figures

DEVICE FOR FOOTWEAR UPPER ASSEMBLING ON RESPECTIVE LASTS OR SHOE TREES

BACKGROUND OF THE INVENTION

This invention relates to a device for assembling uppers on footwear lasts or shoe trees, and particularly the upper at the median portion of the last or shoe tree, that is in the zone at which said last or shoe tree has a highly limited width relative to the end. At such a median portion, the last or shoe tree edge has a substantial radius of curvature to form the so-called slot or aperture.

SUMMARY OF THE INVENTION

It is the object of the present invention to provide an upper assembling device meeting the above mentioned requirements and particularly enabling the upper assembling by a single operation. More particularly, that the edge of said upper is satisfactorily and completely attached to the sole of a footwear carried by the last or shoe tree. Thus, the drawback is avoided of having to carry out upper assembling in different stages, which obviously would adversely affect the work and production rate.

The device according to the invention is characterized in combination with per se means known for clamping the upper edge to stretch and fold up such an edge against the sole and with complementary clamping clips for holding the upper edge at the last or shoe tree hollow. A right set and one left set of members for upper edge adherence at the last or shoe tree hollow. The aforementioned members are divided into two or more sections independently oscillating about axes approximately parallel to the direction of approaching movement to the last or shoe tree, and independently oscillating about an axis which is approximately horizontal and perpendicular to said direction. The oscillation being controlled by motors that are inependent for each individual section. Moreover, each of the right and left sets, is adjustable in height and orientable about an axis parallel to the last or shoe tree approach direction.

Obviously, the present invention also relates to the upper preassembling and assembling operations, according to which the upper after clamping at the edge, is adapted and caused to adhere to the last or shoe tree, and then the edge of the upper is displaced at the last or shoe tree hollow in a direction substantially converging to the last or shoe tree toe. The edge of the upper is folded by orientable members against the sole as presented by said last or shoe tree, and the upper is compressed against the sole.

The invention will now be disclosed by the following description referring to the accompanying drawings, showing by way of example a preferred embodiment of the device, as applied to an oleodynamic type of upper assembling machine, not shown.

IN THE DRAWINGS

DESCRIPTION OF THE INVENTION

Figure 1:
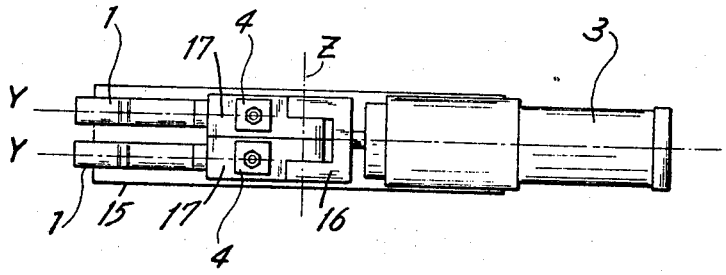
FIG. 1 is a top view of the device according to the invention.

The device according to the invention comprises modeling members 1 independently oscillating about their own axes y and secured to stem 2 of respective piston 3, the forward movement thereof occurring along axis x.

The unit comprising the invention is restrained to the machine, not shown, by a support 9 and has a substantial tridimensional mobility to select the best position to start the processing cycle.

The cycle starts with modeling members or plates 1 forward moving along axis x through sliding of piston 2 within cylinder 3.

The plates cause upper adherence to the last or shoe tree hollow, the upper being maintained taut by suitable pliers, and are rotable about y axes to follow the aperture contour for an improved results.

Figure 4:
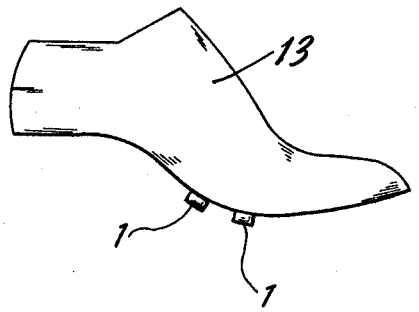
FIG. 4 shows the operating position for the modeling plates, laterally of the footwear last or shoe tree being processed.

By admitting oil under pressure in cylinders 4 through a conduit 5, piston 6 is operated and rotably drives said modeling plates 1 about an axis Z (hatched portion in FIG. 1): this rotation is independent for the two plates or rods 1, since each of the latter should be freely rotable until being stopped by the last or shoe tree bottom, and this occurs at two different positions, as clearly shown in FIG. 4.

Thus, pressing is provided, that is, a compression action of the upper against the cork sole, which is for adhesion by means of a layer of adhesive between said upper and cork sole. The cycle terminates with the device moving back to its initial or starting position.

In order to aid in footwear assembling, in addition to rotation of pressing-modeling members 1 about axes y, the adjustment is contemplated for the inlet height or level thereof by means of a screw 7 acting against a spring 8, causing the device to rotate about an axis W and a relative displacement between said plates 1 and cork sole plane.

Moreover, the whole device is rotable about axis x and this for better accomodating the slope or inclination of the last or shoe tree hollow.

By way of better understanding the aforementioned, it is to be noted that on the right and left sides of the last (13), two identical and symmetrical units are placed, one only of which is shown in the figures. Each of said units is wholly carried by a respective fixed support (9) capable of making an angular displacement around a transverse axis W. More precisely the support (9) carries a transverse pin (placed in correspondence with the axis W); on such pin the forked strap (10) is hinged in which fluid dynamic cylinder (3) is set up having the possibility to rotate around the respective X axis. A plate element (15) is joined with the fluid dynamic cylinder (3), being developed parallel to the axis X; and on the same, a block (16) connected with the shank (2) of said cylinder (3) can slide. The block (16) presents a fork portion with which two parallel plate bodies (17), bearing the two shaping members (1), are joined and are able to swing around an axis Z perpendicular to said axis X.

Figure 2:
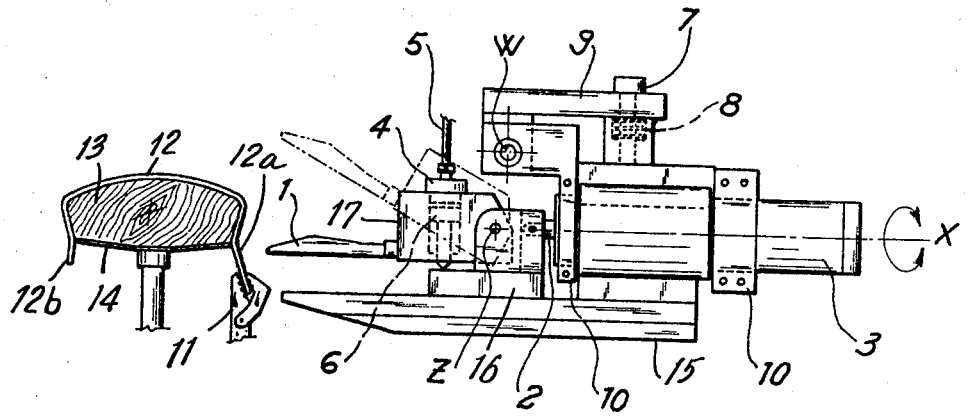
FIG. 2 is a side view of the device shown at rest or inoperative position.

As explained herein, the shaping members (1) can swing around the axis Z one independently over the other (a line in FIG. 1 indicates separation between the two bodies). Each of the bodies (17) has a respective fluid dynamic little cylinder (4), the shank of which [joined with the piston (6)] engages with the base portion of the block (16) so that outward movement of the same shank causes an angular displacement of the relative body (17), as shown by hyphens in FIG. 2.

The axis of the little cylinders (3) are approximately perpendicular to the axis Y of the units (1).

In order to get an angular displacement of the whole unit around the axis W, an adjustment screw (7) is provided, opposed by a spring (8), joining the fixed support (9) with the strap (10). Finally each of the shaping members (1) are mounted on the respective body (17) and can rotate around its axis Y.

To regulate the height of the shaping members (1) in respect of the last (13) the screw (7) is adjusted so as to displace the unit in an angular manner around the axis W, to further regulate position of the members (1) the cylinder (3) as well as the plate member (15) (joined to it) can be slightly rotated round the axis X so as to equal the position of the members (1) to the lower portion of the last (13) (FIG. 4).

Figure 3:
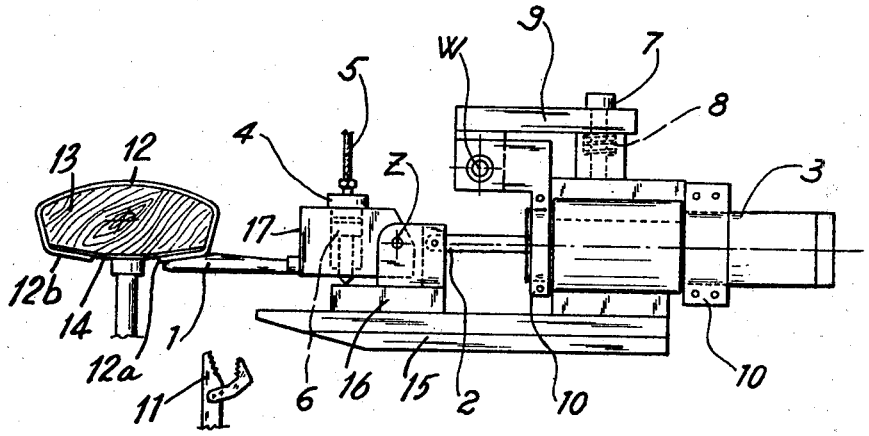
FIG. 3 is a view similar to FIG. 1 showing the modeling members inserted against the upper.

Then the pliers (11) intervene to pull the upper (2), and the cylinders (3) and (4) begin to act in accordance with the movement of the same pliers. More precisely, at first the cylinder (3) starts to work in such a way to make the block (16) advance on the plate member (15) to carry the shaping members (1) to engagement with the upper (12), while the pliers (11) are opened (FIG. 3). The edges (12*a*), (12*b*) of the upper (12) are folded on the lower surface of the cork sole (14). Then the little cylinders (4) start to work in order to strongly press the same edges, by means of the members (1), against the last (13). This compression causes a perfect adhesion of the edges (12*a*) and (12*b*) to the cork sole (14) via a coat of glue previously put therebetween.

The action is very effective due to the strong pressure that the little cylinders (4) transmits transversely against the members (1) and owing to the possible independent movement of the two members (1).

What I claim is:

1. An improved apparatus for assembling a footwear upper on respective lasts, particularly for sole connection of the last or shoe tree, employing plier means defined by gripping members for clamping an edge portion of said upper and moving said edge portion downward on to said last, shaping members associated therewith for positioning said edge on said upper to the last and on to a footwear cork sole, said improvement comprising: said plier means being disposed to cooperate with said shaping members formed of a pair of complementary longitudinal elements laterally arranged at the last, said elements being independently rotatable through fluid dynamic means to move about the longitudinal axis for stretching said upper at a ball portion thereof and being disposed substantially transverse to said last; said shaping members are secured to respective supports by adjustment means enabling the displacement thereof in one direction along a plane parallel to the last; and a support member carrying said elements is pivotable with respect to an axis to said supports, for rotation about said axis by screw adjustment.

* * * * *